US006193360B1

(12) United States Patent
Nishiwaki et al.

(10) Patent No.: US 6,193,360 B1
(45) **Date of Patent: *Feb. 27, 2001**

(54) INK-JET RECORDING HEAD

(75) Inventors: Tsutomu Nishiwaki; Yoshinao Miyata, both of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/788,957

(22) Filed: Jan. 24, 1997

(30) Foreign Application Priority Data

| | | |
|---|---|---|
| Jan. 26, 1996 | (JP) | 8-12115 |
| Mar. 27, 1996 | (JP) | 8-71892 |
| Jul. 2, 1996 | (JP) | 8-191484 |

(51) Int. Cl.[7] ..... B41J 2/045
(52) U.S. Cl. ..... 347/70; 347/94
(58) Field of Search ..... 347/70, 71, 20, 347/97

(56) References Cited

U.S. PATENT DOCUMENTS

| | | | | |
|---|---|---|---|---|
| 5,764,255 | * | 6/1998 | Tsurui et al. | 347/70 |
| 5,943,079 | * | 8/1999 | Yoshida et al. | 347/94 |
| 5,956,059 | * | 9/1999 | Usui | 347/71 |

FOREIGN PATENT DOCUMENTS

| | | | |
|---|---|---|---|
| 0657289A | 6/1995 | (EP) . | |
| 0670218A | 9/1995 | (EP) . | |
| 0761447A | 3/1997 | (EP) . | |
| 3-45815 | 9/1991 | (JP) | B41J/2/175 |

OTHER PUBLICATIONS

Patent Abstracts of Japan, vol. 004, No. 114 (M–026), Aug. 15, 1980 & JP 55 071569 A (Fujitsu Ltd.), May 29, 1980, abstract.
Patent Abstracts of Japan, vol. 016, No. 487 (M–1323), Oct. 9, 1992 & JP 04 179549 A (Seiko Epson Corp), Jun. 26, 1992, abstract.
Patent Abstracts of Japan, vol. 008, No. 146 (M–307), Jul. 7, 1984 & JP 59 042964 A (Fujitsu KK), Mar. 9, 1984, abstract.
Patent Abstracts of Japan, vol. 097, No. 010, Oct. 31, 199 & JP 09 141856 A(Brother Ind Ltd), Jun. 3, 1997, abstract.
Patent Abstracts of Japan, vol. 097, No. 010, Oct. 31, 1997 & JP 09 141857 A (Brother Ind Ltd), Jun. 3, 1997, abstract.

* cited by examiner

*Primary Examiner*—David F. Yockey
*Assistant Examiner*—Michael S Brooke
(74) *Attorney, Agent, or Firm*—Sughrue, Mion, Zinn, Macpeak & Seas, PLLC

(57) ABSTRACT

To suppress an increase in the pressure of an ink reservoir caused by the ink reversely flowed from an ink cavity without causing a lead wire to be damaged or to get fatigued. A thin portion 13 which becomes resiliently deformed by the ink reversely flowed from an ink cavity 2 is provided in the area of a compliance plate facing an ink reservoir 4.

4 Claims, 10 Drawing Sheets

INK-JET RECORDING HEAD

BACKGROUND OF THE INVENTION

The present invention relates to an ink-jet recording head of an ink jet recording apparatus and, more particularly, to the structure of an ink reservoir for supplying ink to an ink cavity which generates pressure for use in ejecting ink droplets.

An ink-jet recording head is a device which records an image on recording paper by pressurizing an ink cavity filled with ink so as to jet ink from a nozzle orifice (or an opening). As inexpensive color ink-jet printer have recently become more popular, a demand has grown for a high-density nozzle orifice and a compact ink-jet head. To meet this demand, a spacer which constitutes a space for pressurizing ink to eject ink droplets, or an ink flow path such as a so-called ink cavity, is formed by anisotropic etching. In the anisotropic etching operation, a silicon monocrystalline substrate is etched using an alkaline liquid, so that the difference in etch rates in the crystallographic axis is utilized.

FIGS. 15A and 15B show one example of an ink-jet recording head which uses a spacer S formed by anisotropically etching a silicon monocrystalline substrate. A plurality of substantially-rectangular ink cavities A are formed in the spacer S on constant pitches in the direction of a shorter side of the cavity. In the direction of a longer side of each ink cavity A, the ink cavity A is connected at one end to an ink reservoir C via an ink supply port B. A nozzle orifice D for ejecting ink is formed in the other end of each ink cavity A.

A resilient plate E is fitted to one side of the spacer S of the recording head that has flow paths such as the ink cavities A formed therein. Further, a nozzle plate F having the nozzle orifices D formed therein is fitted to the other side of the spacer S.

A lower electrode H which is to serve as a common electrode, piezoelectric films J formed so as to correspond to the ink cavities A, and upper electrodes K which are formed so as to correspond to the ink cavities A and to serve as segment electrodes, are formed in that order on the surface of the resilient plate E.

A drive signal is fed to these electrodes from outside via an electrically conductive pattern (not shown) formed on the surface of the resilient plate E. A terminal for receiving a flexible cable which connects the electrically conductive pattern to an external drive circuit, is usually provided along one end of the recording head.

In contrast, in the ink-jet recording head having the previously-described structure, ink other than the ink ejected from the nozzle orifices D reversely flows to the ink reservoir C from the ink supply ports B if the plurality of ink cavities A are pressurized. If a large quantity of ink reversely flows to the ink reservoir C, the pressure of the ink reservoir C will increase, thereby resulting in the ink flowing into the unpressurized ink cavities A. As a result, ink droplets will be ejected from the nozzle orifices D of the unpressurized ink cavities A. Such interaction arising between adjacent ink reservoirs (cross-stroke) is not a desirable phenomenon in the ink-jet recording head.

It is necessary to prevent the pressure of the ink reservoir C from increasing in order to eliminate such a problem. To this end, a thin portion M which is likely to be deformed as a result of an increase in the pressure of the ink reservoir C due to the reverse flow of ink from the ink cavity A, is formed in the resilient plate E so as to correspond to the ink reservoir C.

In filling an ink-jet head with ink by, e.g., replacing a used ink tank with a new one, it is necessary to forcibly introduce the ink to the flow path of the recording head from the ink tank by exerting a strong negative pressure on the ink tank through the nozzle orifice D.

The area of the resilient plate corresponding to the ink reservoir C, i.e., the thin portion M, is deformed as a result of exertion of the negative pressure generated when the ink is introduced. As a result, the lower electrode H, the piezoelectric film J, and the upper electrode K stacked on the resilient plate E also experience large stress, and hence they are significantly deformed, which in turn results in the upper electrode K becoming apt to break.

The present invention has been conceived in light of the aforementioned drawback in the conventional one.

An object of the present invention is to provide an ink-jet recording head capable of preventing break in a line while reducing interaction to as small as possible.

To solve the previously-described problem, the present invention provides an ink-jet recording head comprising: a nozzle plate having a plurality of nozzle orifices formed therein for ejecting ink in the form of an ink droplet; a spacer made comprising, substantially-rectangular ink cavities for pressurizing ink which are respectively connected to the nozzle orifices and are arrayed on constant pitches in the direction of a shorter side of the ink cavity, ink supply ports connected to the respective ink cavities for supplying ink, and an ink reservoir connected to the ink supply ports for supplying ink to the plurality of ink cavities, wherein the nozzle plate seal one surface of the spacer; a resilient plate sealing the other side of the spacer and brings about variations in the pressure of the ink cavity; a piezoelectric substance formed on the surface of the resilient plate; upper electrodes formed so as to respectively correspond to the ink cavities in order to apply a signal to the piezoelectric substance; a thin portion which is elastically deformable when being subjected to the ink reversely flowed from the ink cavity and is formed at least in either a portion of the nozzle plate being opposite to the ink reservoir or in an interior of the ink reservoir.

Even if ink reversely flows into an ink reservoir from an ink cavity, a portion other than a resilient plate is deformed. The resilient plate is not deformed, and therefore electrodes formed on the resilient plate are not deformed. Further, another element is deformed to absorb pressure as a result of reverse flow from the ink cavity.

DETAILED DESCRIPTION OF THE PREFERRED EMBODIMENT

The present invention will be described in detail on the basis of its illustrated embodiments.

Figure 1:
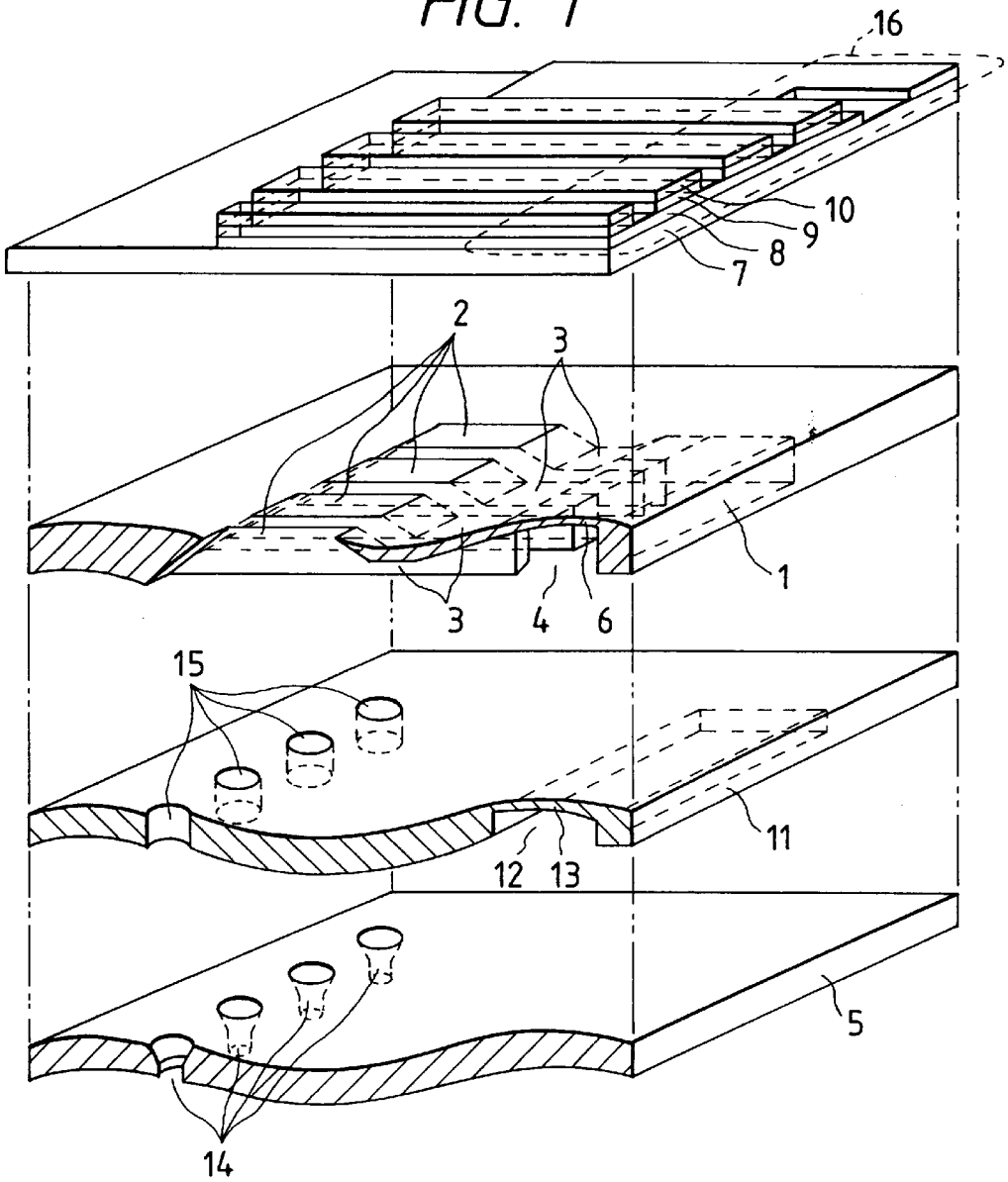
FIG. 1 is an exploded perspective view showing one embodiment of an ink-jet recording head.
Figure 2:
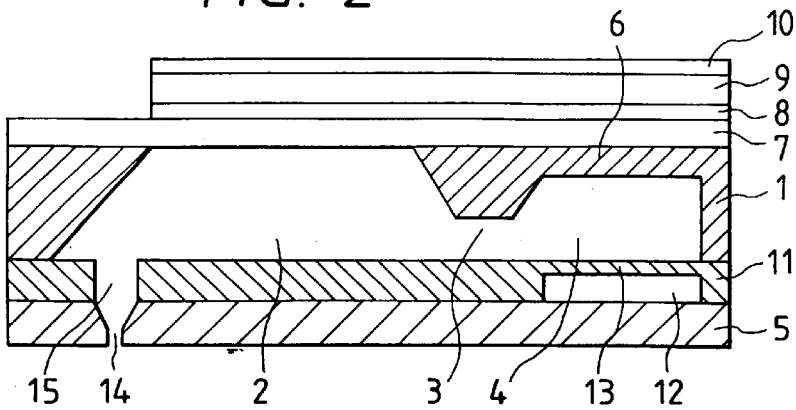
FIG. 2 is a cross-sectional view of the recording head.

FIGS. 1 and 2 show one embodiment of an ink-jet recording head of the present invention. In the drawings, reference numeral 1 designates a spacer. Ink cavities 2, ink supply ports 3, and ink reservoirs 4 are formed by anisotropically etching a silicon monocrystalline substrate. The ink cavities 2 are formed in the form of through-holes, and the ink supply ports 3 and the ink reservoirs 4 are formed in the form of recesses having their openings facing towards a nozzle plate 5 which will be described later. As a result of formation of the ink supply ports 3 and the ink reservoirs 4 in the form of recesses, the ink supply ports 3 can be provided with fluid resistance necessary to eject ink droplets. Further, the rigidity of the area of a resilient plate 7 corresponding to the ink reservoir 4 is increased by forming a thin portion 6. A lead electrode 16 which is to be formed in that area and will be described later, is prevented from becoming deformed.

Reference numeral 7 designates the previously-described resilient plate for sealing one side of the spacer 1. A lower electrode 8, a piezoelectric film 9, and an upper electrode 10 are formed in that order on the resilient plate.

A compliance plate 11 is interposed between one side of the spacer 1 and the nozzle plate 5 which will be described later. A thin portion 13 is formed in the compliance plate so as to correspond to the ink reservoir 4, and the thin portion 13 has a recess 12 facing toward the nozzle plate 5. Through holes 15, each connecting one end of the ink cavity 2 to the nozzle orifice 14, are formed in the compliance plate 11 so as to correspond to the nozzle orifices 14.

On the previously-described nozzle plate 5, the nozzle orifices 14 are formed in the nozzle plate on constant pitches such that each nozzle orifice 14 is connected to one end of the ink cavity 2. The nozzle plate 5 is brought into close contact with the compliance plate 11. By virtue of the recess 12 of the compliance plate 11, a space is formed which permits deformation of the thin portion 13 of the compliance plate 11.

A silicon monocrystalline substrate having a thickness of about 150 to 300 $\mu$m (micrometers) is usually used as the silicon monocrystalline substrate forming the spacer 1. However, a silicon monocrstyalline substrate having a thickness of about 180 to 280 $\mu$m is desirable, and preferably about 220 $\mu$m.

The thickness of the silicon monocrystalline substrate depends on the cost of the silicon monocrystalline substrate and the fact that the ink reservoirs 4 are usually arrayed at densities of 180–360 reservoirs per inch.

Where one ink cavity 2 is pressurized to carry out a printing operation, a partition wall between one part of the ink cavity 2 and an adjacent part of ink cavity 2 will become deformed if the partition wall is thin. Pressure also propagates in the one part of the ink cavity 2 one part of the adjacent to the ink cavity 2 so that ink droplets are ejected. As a result, ink is ejected from the nozzle orifice 14 which is not originally expected to eject ink droplets, thereby resulting in interaction. To prevent the interaction, the thickness of the ink cavity is increased to a much greater extent, and the ink cavities are made shallow. In short, the rigidity of each partition wall can be increased by reducing the thickness of the silicon monocrystalline substrate.

However, the degree of reduction in the width of the ink cavity 2 is obviously limited because the quantity of discharge of ink must be ensured. Further, it is practically impossible to increase the rigidity of the partition wall between the ink cavities by increasing the thickness of the partition wall.

In contrast, if the rigidity of the partition wall is increased by reducing the thickness of the silicon monocrystalline substrate, it is necessary to obtain a very thin wafer of a silicon monocrystalline substrate. If a silicon monocrystalline ingot having a large diameter is sliced into the thin substrates, a cutting margin will form an increasing large proportion of the entire area of the substrate. Further, slicing accuracy also decreases. Therefore, a precise slicing operation becomes necessary, which in turn results in increased costs. In view of these circumstances, it is desirable to use a silicon monocrystalline substrate having a thickness of 180 to 280 $\mu$m and, more particularly, to use a silicon monocrystalline substrate having a thickness of 220 $\mu$m in order to reduce the cost of a silicon monocrystalline substrate.

To form the ink cavities in the silicon monocrystalline substrate at a high density, it is desirable to use a silicon monocrystalline substrate of (110) orientation. More specifically, since the ink cavities 2 are required to have a high density in the direction in which they are arranged, it is necessary to form the ink cavity such that the surfaces of the ink cavity 2 in its longitudinal direction become (111) planes perpendicular to the (110) plane. To this end, it is absolutely necessary to anisotropically etch a silicon monocrystalline substrate of (110) orientation using an alkaline solution such as KOH. A shorter-side surface of the ink cavity 2 forms an angle of about 70 degrees with respect to the (111) plane in the longitudinal direction of the cavity and comes about as a (111) plane perpendicular to the (110) plane. As a result, the nozzle orifice 14 is tapered, thereby contributing to prevention of settlement of the ink.

If the spacer is formed by anisotropically etching the silicon monocrystalline substrate, there will be another advantage of making it possible to integrally form the resilient plate 7, the lower electrode 8, the piezoelectric film 9, and the upper electrode 10 through processes by using a film forming technique in combination with anisotropic etching, in addition to the advantage of allowing high-density layout of the ink cavities 2.

Figure 3I:
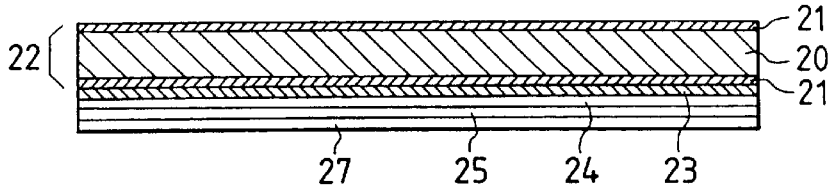
FIGS. 3I–3VII and 3I'–3VII' show manufacturing steps for a spacer, a resilient plate, a lower electrode, a piezoelectric vibration film, and an upper electrode of the recording head.
Figure 3I:
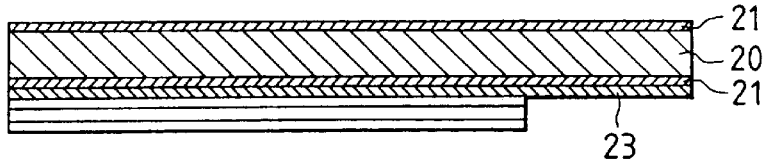
Figure 3I:
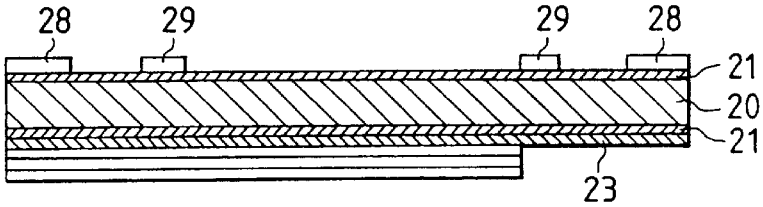
Figure 3I:
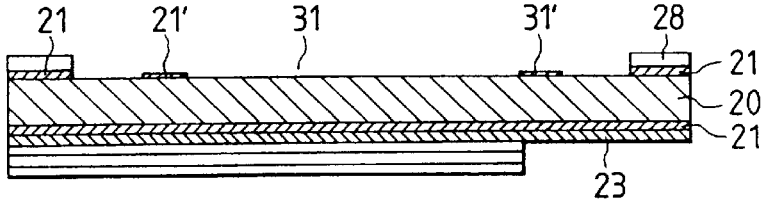
Figure 3V:
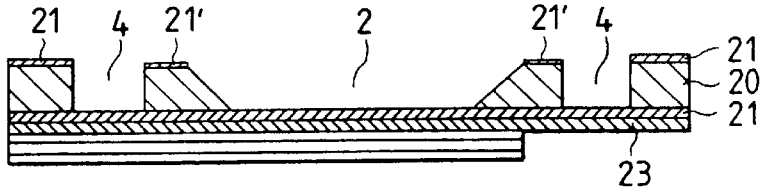
Figure 3V:
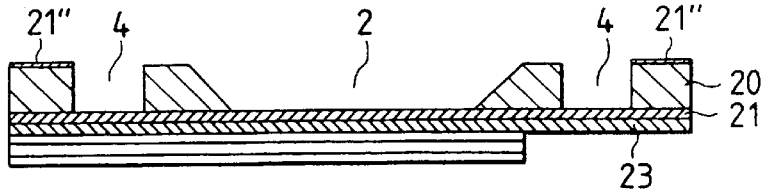
Figure 3V:
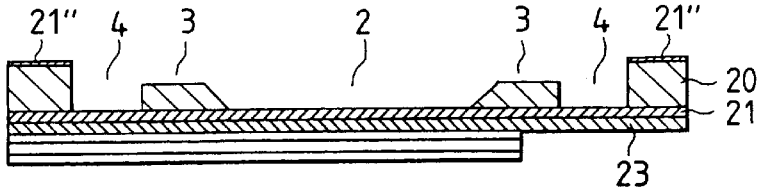
Figure 3I:
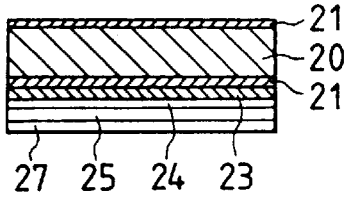
Figure 3I:
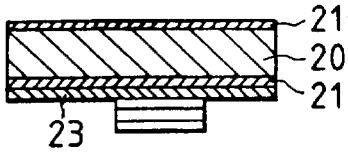
Figure 3I:
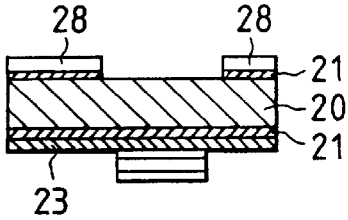
Figure 3I:
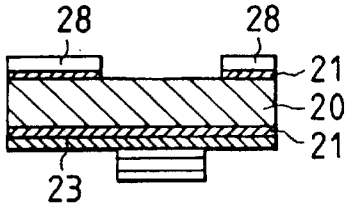
Figure 3V:
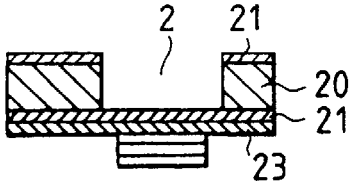
Figure 3V:
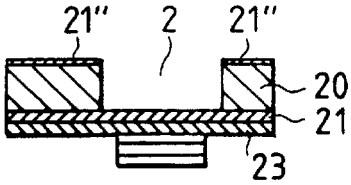
Figure 3V:
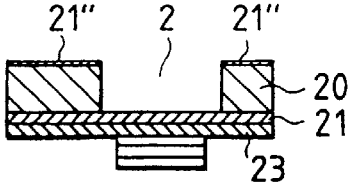

FIGS. 3I to 3VII and 3I' to 3VII' show one embodiment in which a spacer, a resilient plate, a lower electrode, a piezoelectric film, and an upper electrode are formed through a sequence of processes.

A method of manufacturing the previously-described spacer, resilient plate, and pressure generation means will be described with reference to FIGS. 3I to 3VII and 3I' to 3VII'.

FIGS. 3I to 3VII are longitudinal cross-sectional views of the ink cavity, and FIGS. 3I' to 3VII' are transverse cross-sectional views of the ink cavity.

A base material 22 is prepared by forming a silicon dioxide layer 21 to a thickness of about 1 micrometer on the entire surface of a silicon monocrystalline substrate 20 having its surface sliced in a (110) orientation, using thermal oxidation or the like. The silicon dioxide layer 21 serves as an etching protection film when the silicon monocrystalline substrate 20 is etched as well as serving as an insulating film of a drive section to be formed on the base material.

A zirconia ($ZrO_2$) film is formed on the surface of the silicon dioxide layer 21 by sputtering. The zirconia film is thermally oxidized to form a resilient film 23 which consists of zirconia having a thickness of 0.8 $\mu$m. The resilient film 23 made of zirconia has a high Young's modulus and is capable of converting the distortion of the piezoelectric film 25, which will be described later, to flexible displacements with high efficiency. A platinum (Pt) film is formed on the surface of the resilient film 23 to a thickness of about 0.2 $\mu$m by sputtering, so that a lower electrode 24 is formed.

Piezoelectric material such as PZT is formed on the surface of the lower electrode to a thickness of 1 micrometer by sputtering or the like, so that a piezoelectric film 25 is formed. An upper electrode 27 is formed from aluminum (Al) on the surface of the piezoelectric film to a thickness of 0.2 $\mu$m by sputtering or the like (I).

The upper electrode 27, the piezoelectric film 25, and the lower electrode 24 are patterned so as to correspond to the layout of the ink cavities 2, and the substrate is cut into piezoelectric elements.

When being patterned, the upper electrode 27 is independently drawn so as to correspond to each ink cavity 2, whereby it doubles as a lead wire which connects the piezoelectric element to the drive circuit (II).

Photoresists 28 and 29 are formed such that the ink cavities 2 are oriented in the direction of a lattice of a <−1−1−2> zone axis parallel to (1−1−1) and (110) zone planes or in the direction of a lattice <112> equivalent to the zone axis (III). The silicon dioxide layer 21 is removed by use of a buffer hydrofluoric acid fluid composed of a mixture of hydrofluoric acid and ammonium fluoride in proportions of 1:6. As a result, a window 31 for anisotropic etching purposes is patterned.

The photoresist 29 on the silicon dioxide layer in the area where the ink supply port 3 is to be formed is again exposed to light, and the thus-exposed photoresist is developed. Subsequent to such a so-called multi-exposure process, the silicon dioxide layer is half-etched by use of the previously-described buffer hydrofluoric acid fluid for about five min. such that the thickness of the silicon dioxide layer below the photoresist layer 29 is reduced to about 0.5 $\mu$m (IV).

After removal of the resist layer 28, the base material 22 is immersed in a 10% potassium hydroxide solution heated up to about 80° C. (degrees centigrade), whereby the base material is anisotropically etched. The silicon dioxide layers 21 and 21' which acted as the protective film against anisotropic etching are also gradually dissolved and are etched away by a thickness of about 0.4 $\mu$m. As a result, the silicon dioxide layer 21' in the area where the ink supply port 3 is to be formed is reduced to a thickness of about 0.1 $\mu$m, whereas the silicon dioxide layer 21 in the other area is reduced to a thickness of about 0.6 $\mu$m (V).

The base material 22 is immersed in the buffer hydrofluoric acid fluid for the period during which the silicon dioxide layer having a thickness of 0.1 $\mu$m can be removed; e.g., about one minute. As a result, the silicon dioxide layer 21' in the area where the ink supply port 3 is to be formed is removed, whereas the silicon dioxide film 21 in the other area is left as a layer 21" having a thickness of about 0.5 $\mu$m (VI).

The base material 22 is anisotropically etched so as to selectively etch the area of the ink supply port 3 again by immersing it in a potassium hydroxide solution of about 40%. As a result, the thickness of the area of the ink supply port 3 is reduced, so that a recess having fluid resistance required by the ink supply port 3 is formed (VII).

In the previously-described embodiment, the piezoelectric film 24 is separated after having been patterned so as to be identical with the upper electrodes 10. Only the area of the piezoelectric film 24 where the upper electrode 10 and the lower electrode 8 overlap becomes displaced, and hence the above-described patterning of the piezoelectric film 24 does not become absolutely necessary.

Since it is necessary to connect the piezoelectric elements to the flexible cable in order to apply a drive signal to the upper electrode 10 and the lower electrode 8, a lead electrode 16 is provided, as shown in FIG. 1. The lead electrode 16 is formed so as to extend to the end of the recording head while the piezoelectric film 9 acts as an insulating film between the upper electrode 10 and the lower electrode 8. The piezoelectric film is a ferroelectric substance having a dielectric constant of about 800 to 3000. Therefore the electrostatic capacitance of the lead electrode 16 becomes large, thereby resulting in increased charging current and dielectric loss. For this reason, it is desirable to form the lower electrode 8 from an insulating material other than a piezoelectric material and to use that lower electrode as an insulating film.

Figure 4I:
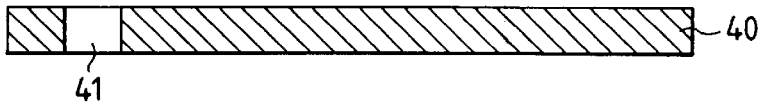
FIGS. 4I–4IV show one embodiment of manufacturing steps for a compliance plate of the recording head.
Figure 4I:
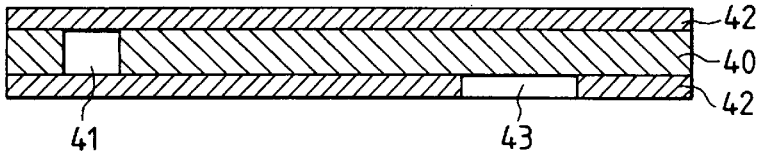
Figure 4I:
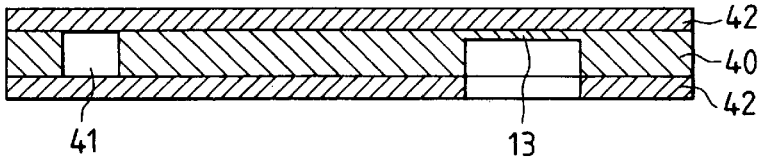
Figure 4I:
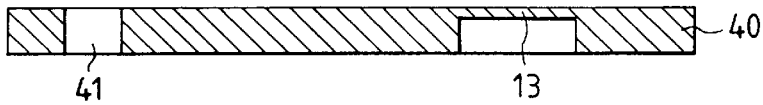

One embodiment of a method of manufacturing a compliance plate will be described with reference to FIGS. 4I to 4IV.

A through hole 41 is formed in a plate material 40 such as stainless steel by pressing (I), and a dry film 42 which is a photosensitive plastic sheet is bonded to both sides of the plate material 40 by laminating or the like. The area of one dry film 42 where the thin portion 13 is to be formed is exposed and developed so as to be removed, whereby a window 43 for etching purposes is formed (II).

After these preparations have been completed, a recess is formed to a predetermined depth by use of a liquid suitable for use in etching the plate material 40 in a time controlled manner, whereby the thin portion 13 is formed (III). A compliance plate is finished by removing the dry films 42, 42 after the etching operation has been completed (IV).

Figure 5I:
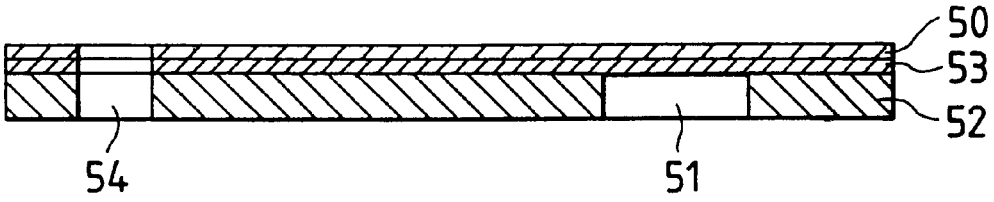
FIGS. 5I and 5II show another embodiment of manufacturing steps for a compliance plate of the recording head.
Figure 5I:
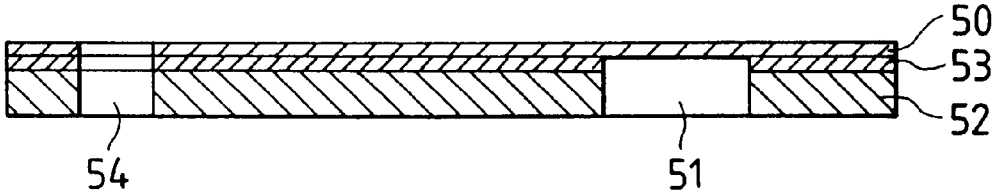

FIGS. 5I and 5II show another embodiment of the compliance plate 11 of the ink-jet recording head of the present invention. In this embodiment, a first plate material 50 which is formed from stainless steel or the like to a thickness suitable for the thin portion 13 is stacked on a second plate material 52 which has the same thickness as the depth of the recess 12 and has a through hole 51 previously formed in its area to be formed into the thin portion 13. They are bonded together while a dry film 53 sandwiched between them. Then, a through hole 54 is formed in the area of the thus-formed laminate corresponding to the through hole 15 (I). The uncovered dry film 53 in the through hole 51 is removed by photolithography, as required (II).

According to the present embodiment, it is possible to control the thickness of the thin portion 13 with the same roll accuracy as that with which the first plate material 50 is formed. It is easy to control the thickness of the thin portion by controlling the etching time. Further, it is possible to form a thin portion with high accuracy.

The recess facing the thin portion is formed by pressing the second plate material 52 in the previously-described embodiment. Alternatively, it is also possible to form only the through hole 54 to be formed into a communication hole, in the second plate material 52. In contrast, a window of an etching protective film is formed in the area of the second plate material 52 which is to become the recess 12, as previously described with reference to FIGS. 4I to 4IV. According to the present embodiment, the second plate is etched only as far as the dry film 53. As a result, it is also possible to control the thickness of the thin portion 13 with the same roll accuracy as that with which the first plate material 50 is formed.

Figure 6:
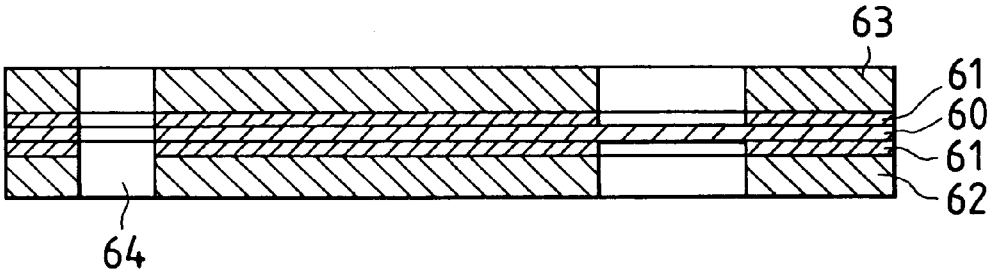
FIG. 6 is a cross-sectional view of the compliance plate of another embodiment.

The recess is formed only in one side of the compliance plate in the foregoing embodiment. Both sides of the first plate material 60 are coated with dry films 61, 61, as shown in FIG. 6. Then, second plate materials 62, 63 are respectively stacked on the dry films. Through holes 64 are formed in the areas corresponding to the communication holes 15 by pressing. In contrast, the areas of the second plate materials 62, 63 which are to be opposite to the recess, are etched. Further, through holes are previously formed in the area of the second plate materials 62 and 63 corresponding to the recess 12 by pressing, whereby it is possible to manufacture the compliance plate which acts as the thin portion 13 with the first plate material 60 between the second plate materials, with high accuracy. According to the present embodiment, the volume of the ink reservoir can be increased, and a silicon monocrystalline substrate for use as a spacer can be thinly formed.

If a drive signal is applied to the lower electrode 8 and the upper electrode 10 in the present embodiment, the piezoelectric film 9 sandwiched between the electrodes is deflected such that the ink cavity 2 becomes concave, whereby the ink cavity 2 expands. As a result of expansion of the ink cavity 2, the ink stored in the ink reservoir 4 flows into the ink cavity 2 through the ink supply port 3.

If electric charges on the piezoelectric film 9 are discharged after a predetermined period of time has elapsed, the piezoelectric film 9 returns to its original state, whereby the ink cavity 2 is compressed. As a result, the ink of the ink cavity 2 is pressurized, and a part of the ink is ejected from the nozzle orifice 14 in the form of ink droplets, so that dots are formed on a recording medium. Further, some of the ink reversely flows to the ink reservoir 4 through the ink supply port 3.

The ink flowing into the ink reservoir 4 temporarily increases the pressure of the ink reservoir 4. At this moment, the thin portion 13 of the compliance plate 11 is deflected such that the recess formed between the compliance plate and the nozzle orifice 5 becomes convex, whereby the volume of the ink reservoir 4 is increased. As a result, the pressure of the ink reservoir 4 drops.

Consequently, the quantity of the ink reversely flows into the ink cavity 2 through the ink supply port 3 is suppressed, and hence printing is carried out without interaction. If the pressure of the ink reservoir 4 drops as a result of attenuation after a predetermined period of time has elapsed, the thin portion 13 returns to its original state by virtue of its resilience.

The nozzle orifices 14 are sealed with capping members (not shown) for replacement of an ink tank, and a negative pressure is exerted on the ink tank. As a result, a measured amount of ink is discharged from the ink tank through the nozzle orifice 14 via the ink reservoir 4 and the ink cavity 2. Even if such a ink introduction operation is carried out, the thin portion 13 of the compliance plate 11 becomes resiliently deformed first, so that the pressure is balanced. As a result, it is possible to suppress the deformation of the lead electrode 16 of the resilient plate 7 to a small degree.

To ensure a decrease in the pressure of the ink reservoir 4 increased as a result of resilient deformation of the thin portion 13, it is absolutely necessary for a compliance value of the thin portion 13 to be greater than all the compliance values of the plurality of ink cavities 2 by more than a constant value.

Provided that an increase in the volume of the ink reservoir resulting from deformation of the thin portion 13 when a certain pressure Pr is applied to the thin portion 13 is AVr, the pressure Pr and the variation AVr are proportional to each other according to a proportional constant Cr. This proportional constant Cr represents the compliance value of the thin portion 13. Similarly, a proportional coefficient Cc between the pressure Pr and the variation AVr obtained when a certain pressure is applied to a composite film which is provided on the ink cavity 2 and is composed of the resilient plate 7, the lower electrode 8, the piezoelectric film 9, and the upper electrode 10, represents the compliance value of the ink cavity 2.

Needless to say, the compliance value Cc of the composite film does not represent all the compliance values of the ink cavity 2. For instance, the partition wall between the ink cavities 2, or others, also contributes to the compliance of the ink cavity. However, in a case where the resilient plate 7 is formed in thin-film manufacturing processes as it is in the previously-described embodiment, the compliance value of the composite film is several to ten times larger than the compliance values of other areas, e.g., the partition walls. Therefore, it is possible to say that the compliance value of the ink cavity 2 is substantially the compliance value Cc of the composite film composed of the resilient plate 7, the lower electrode 8, the piezoelectric film 9, and the upper electrode 10.

The inventor of the present invention found that it was only necessary to establish the following relationship between the compliance value Cr of the thin portion 13, the number of ink cavities 2 "n," and the compliance value Cc of the composite film in order to effectively reduce the pressure of the ink reservoir 4; namely, $$Cr>8\times n\times Cc.$$

The thickness of the thin portion 13 of the compliance plate 11 is designed so as to satisfy the above-described expression, whereby prevention of interaction is ensured, and an ink-jet recording head having a high print quality can be formed.

Figure 7:
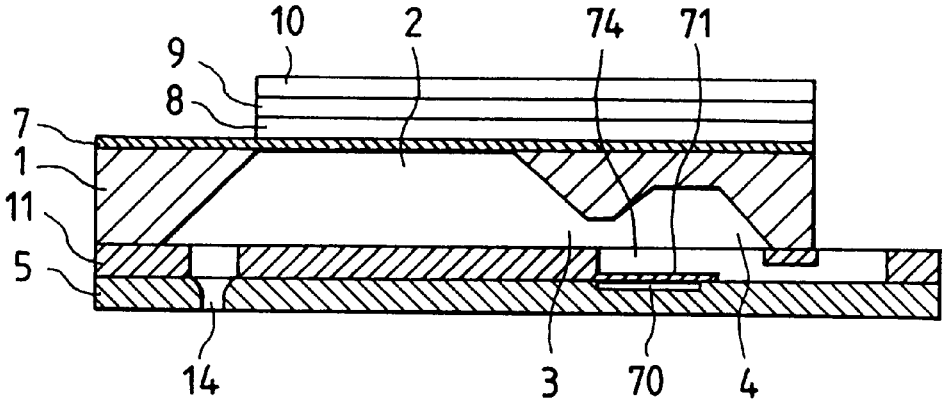
FIG. 7 is a cross-sectional view of the recording head of another embodiment of the present invention.

The recess 12 is formed in the side of the compliance plate 11 facing the nozzle plate 5, and the thin portion 13 is formed in the side of the compliance plate facing the ink reservoir 4 in the previously-described embodiment. However, it is also possible to form a recess 70 in the area of the side of the nozzle plate 5 opposite to the ink reservoir 4 so as to be open toward the ink reservoir, as shown in FIG. 7. Further, it is also possible to form a thin portion 71 which provides a recess toward the ink reservoir, at least in the area of the compliance plate 11 opposite to the recess 70.

According to the present embodiment, the volume of the ink reservoir 4 can be compensated for by means of the compliance plate 11. In consequence, a thin silicon monocrystalline substrate can be used for the spacer 1, and the entire width of the recording head can be reduced.

Figure 8:
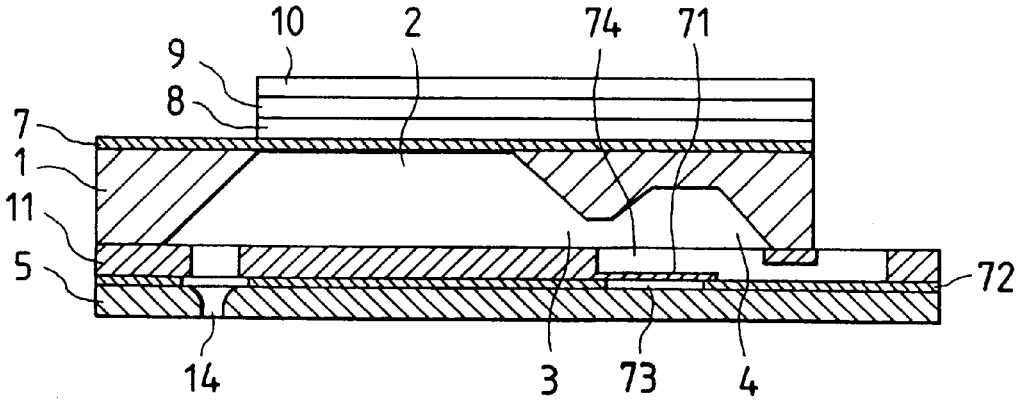
FIG. 8 is a cross-sectional view of the recording head of still another embodiment of the present invention.

In a case where the compliance plate 11 and the nozzle plate 5 are bonded together by an adhesive layer, only the area of an adhesive layer 72 corresponding to the previously-described recess 70 is removed to form a hollow 73, as shown in FIG. 8. It becomes possible to provide the hollow 73 with the same function as that of the recess by utilization of the thickness of the adhesive layer 72.

Figure 9:
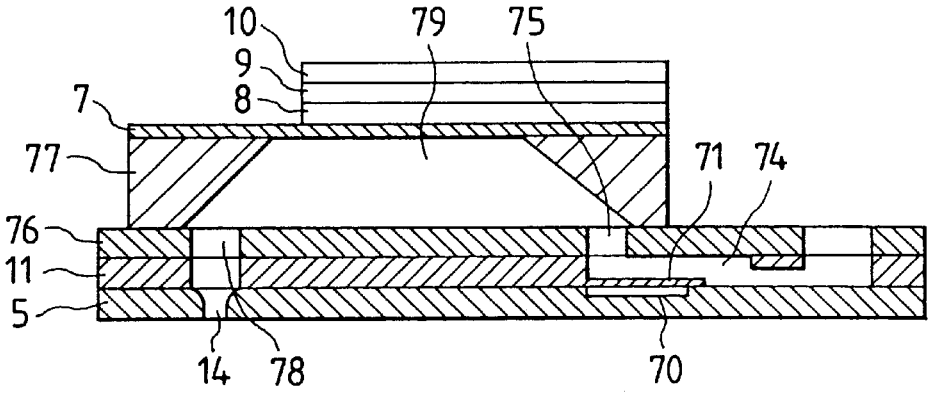
FIG. 9 is a cross-sectional view of the recording head of a further embodiment of the present invention.

If the volume of a communication hole 74 of the compliance plate 11 is sufficiently large to function as the ink reservoir, formation of the ink reservoir in a spacer 77 can be eliminated by providing the spacer 77 on the compliance plate 11 via a third plate 76 which forms an ink supply port 75, as shown in FIG. 9. In the drawing, reference numeral 78 designates a communication hole which connects the nozzle orifice 14 to an ink cavity 79 of the spacer 77.

According to the present embodiment, it is possible to reduce the area of the silicon monocrystalline substrate forming the spacer 77 by at least the area corresponding to the ink reservoir, thereby resulting in reductions in costs. Further, the rigidity of the spacer can be accordingly increased only by removal of the ink reservoir having a comparatively large opening. It is possible to facilitate handling of the spacer during assembly processes.

Figure 10:
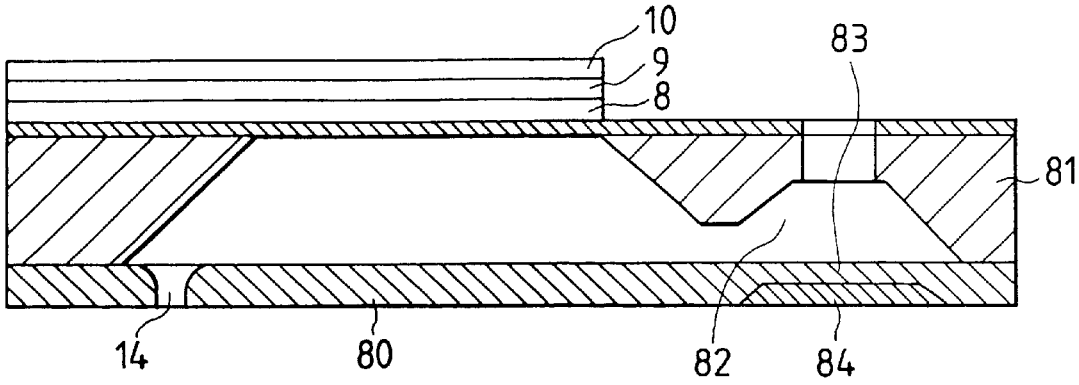
FIG. 10 is a cross-sectional view of the recording head of a still further embodiment of the present invention.

FIG. 10 shows another embodiment of the present invention. In the drawing, reference numeral 80 designates a nozzle plate. A thin portion 83 is formed in the area of a spacer 81 opposite to an ink reservoir 82 in such a way as to provide a recess in the exterior of the nozzle plate. The recess is filled with material which is easy to resiliently deform and to fill; e.g., a high MW polymer material 84, such that the overall nozzle plate becomes flat, as required. In the drawing, reference numeral 14 designates a nozzle orifice.

According to the present embodiment, when the pressure of the ink reservoir 82 is increased at the time of a printing operation, the thin portion 83 of the nozzle plate 80 expands to the outside, whereby pressure is absorbed. Vibrations are effectively absorbed by means of viscous elasticity of the high polymer material 84 filling the thin portion 83. Further, in a case where the nozzle orifice is abraded by an elastic plate such as rubber at the time of a cleaning operation, the ink-jet recording head can smoothly travel without the recess being caught by the resilient plate.

Figure 11:
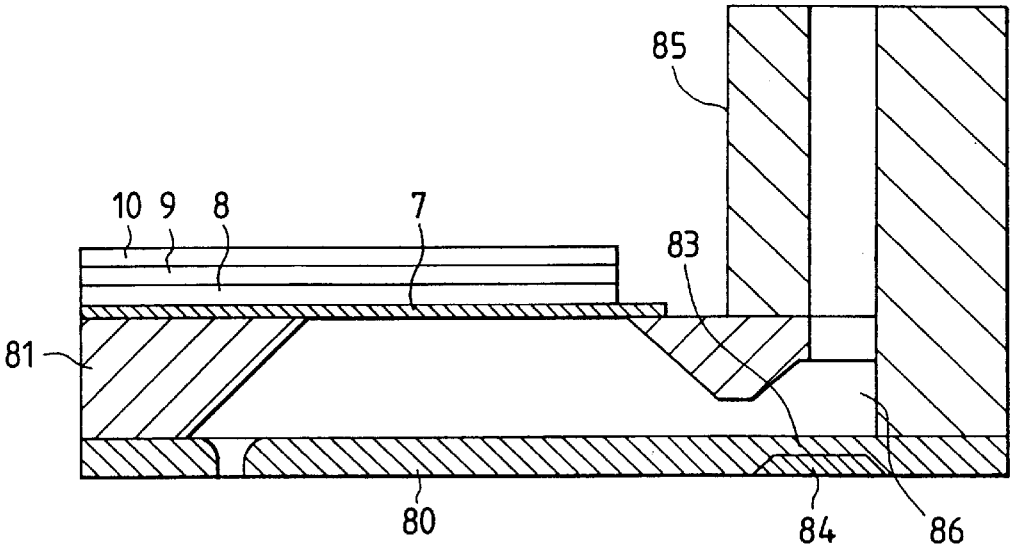
FIG. 11 is a cross-sectional view of the recording head of a still further embodiment of the present invention.

Although the overall ink reservoir 82 is formed by the spacer 81 in the previously-described embodiment, the same operation as that carried out by the ink reservoir 82 can be realized by forming a recess in the area of a head holder 85 for supporting a head which corresponds to the ink reservoir, and by forming an ink reservoir 86 by means of combination of the spacer 81 and the head holder 85, as shown in FIG. 11.

Figure 12:
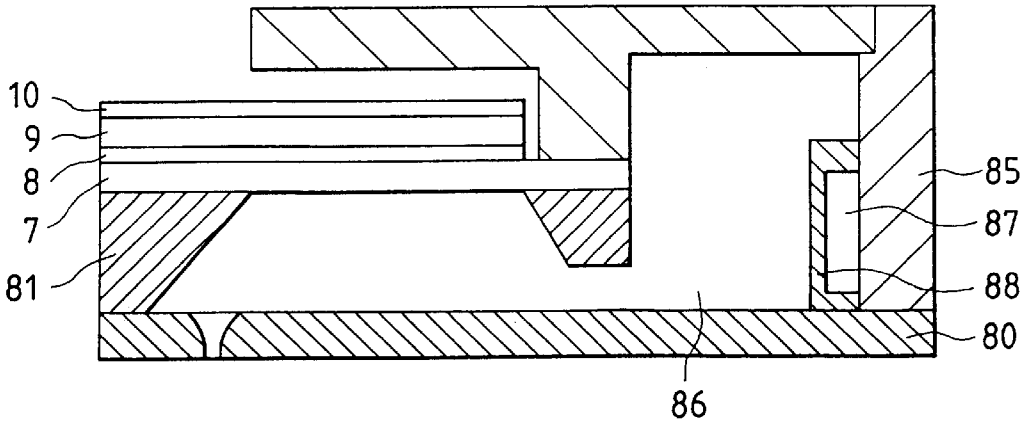
FIG. 12 is a cross-sectional view of the recording head of a still further embodiment of the present invention.
Figure 13:
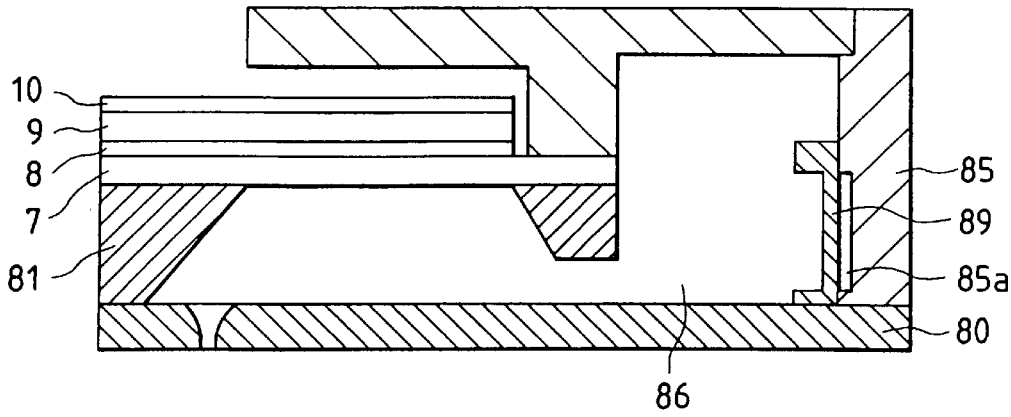
FIG. 13 is a cross-sectional view of the recording head of a still further embodiment of the present invention.

In a case where the ink reservoir 86 is formed by utilization of the head holder 85, formation of a space 87 with respect to the head holder can be ensured, as shown in FIG. 12. Further, the same operation that carried out by the ink reservoir can be attained by fitting a cup member 88, which is resiliently deformable as a result of an increase in the pressure of the ink reservoir 86, to the wall surface of the head holder 85 in a fluid-tight manner, by forming a recess 85*a* in the interior of the head holder 85 as shown in FIG. 13, and by sealing the recess 85*a* in a fluid-tight manner using a plate material 89 which is resiliently deformable as a result of an increase in the pressure of the ink reservoir 86 at the time of a printing operation.

Figure 14:
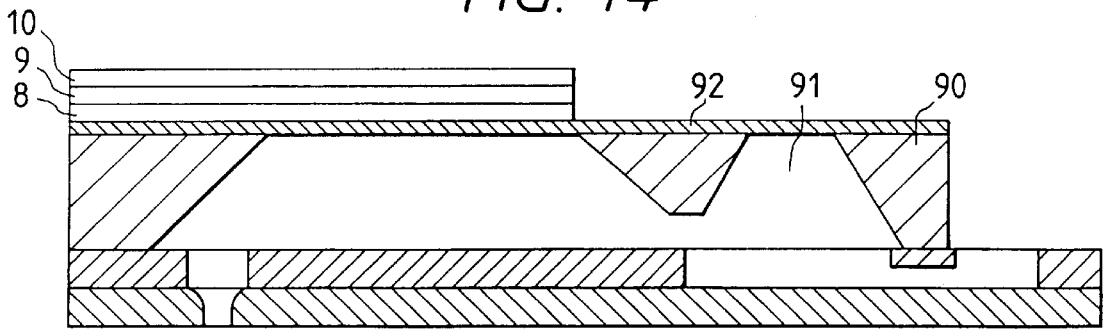
FIG. 14 is a cross-sectional view of the recording head of a still further embodiment of the present invention.
Figure 15A:
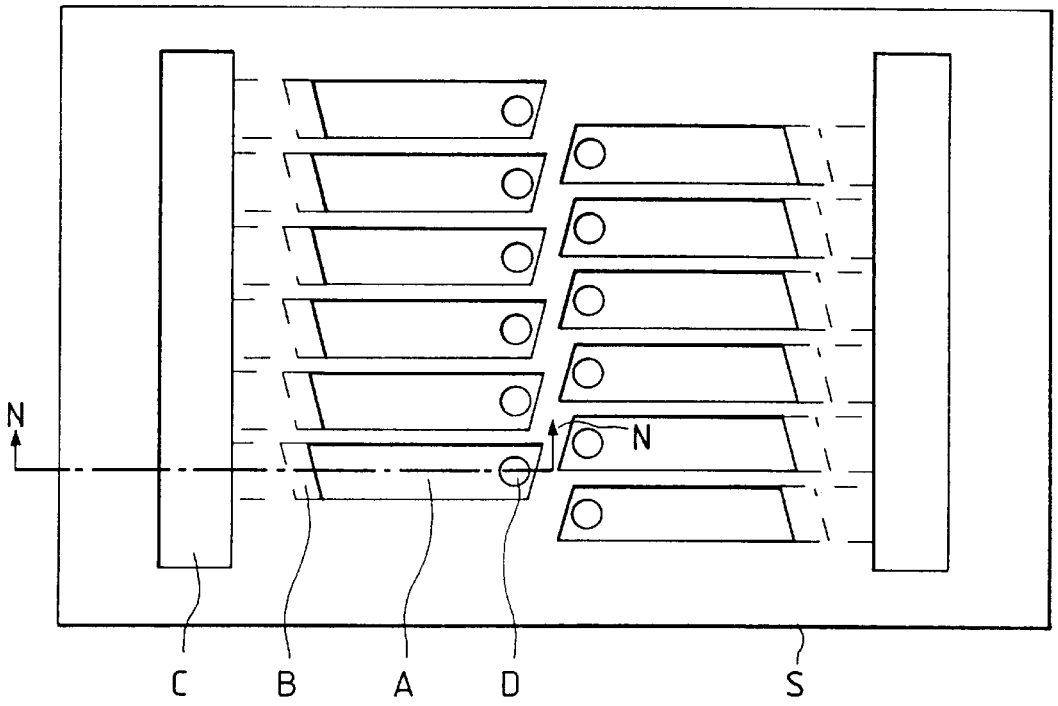
FIG. 15A is a plan view of a spacer which illustrates one example of a conventional ink-jet recording head.
Figure 15B:
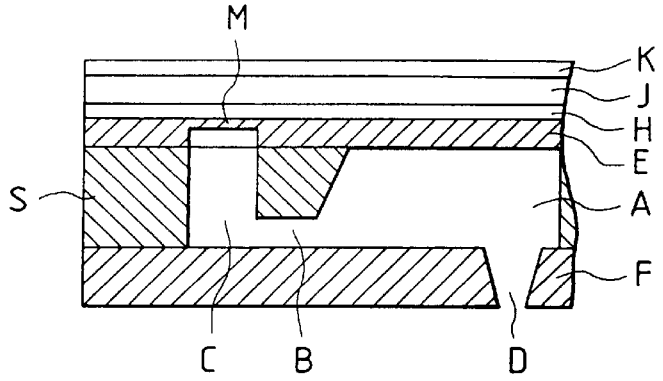
FIG. 15B is a cross-sectional view of the spacer taken across line N—N.

The thin portion is formed in the area of the ink reservoir opposite to the nozzle plate in the previously-described embodiment. However, it is also possible to form an ink reservoir 91 of a spacer 90 as a through hole, as shown in FIG. 14. The area of a resilient plate 92 opposite to the ink reservoir 91 is made deformable as a result of an increase in the pressure of the ink reservoir 91 at the time of a printing operation. Further, the lead area of the lower and upper electrodes may be provided on the nozzle plate.

According to the present embodiment, it is possible to eliminate the areas to be managed with regard to depth and thickness such as the thin portion and the recess, thereby resulting in simplified manufacturing processes.

Although the case where the area which is resiliently deformed as a result of reverse flow of ink from the ink cavity is formed in any one of the nozzle plate, the compliance plate, the head holder, and the resilient plate has been described in the previously-described embodiments, it is possible to effectively reduce an increase in the pressure of the ink reservoir which results from reverse flow of ink from the ink cavity to a much greater extent, by means of a plurality of members.

As has been described above, an ink-jet recording head includes a nozzle plate which has a plurality of nozzle orifices formed therein for ejecting ink in the form of an ink droplet and seals one surface of a spacer; the spacer made up of substantially-rectangular ink cavities for pressurizing ink which are respectively connected to the nozzle orifices and are arrayed on constant pitches in the direction of a shorter side of the ink cavity, ink supply ports connected to the respective ink cavities for supplying ink, and an ink reservoir connected to the ink supply ports for supplying ink to the plurality of ink cavities; a resilient plate which seals the other side of the spacer and brings about variations in the pressure of the ink cavity; a piezoelectric substance formed on the surface of the resilient plate; and upper electrodes formed so as to respectively correspond to the ink cavities in order to apply a signal to the piezoelectric substance.

In the above-described ink-jet recording head, a thin portion which is elastically deformable when being subjected to the ink reversely flowed from the ink cavity, is formed at least in either the area of the nozzle plate being opposite to the ink reservoir or in the interior of the ink reservoir. As a result, even if ink reversely flows into the ink reservoir from the ink cavity associated with a printing operation, the area other than the resilient plate is deformed so as to mitigate an increase in the pressure due to the reverse flow of the ink. In consequence, the resilient plate is prevented from becoming deformed, and hence electrodes provided on the resilient plate are also prevented from becoming deformed. Further, in a case where a sucking pressure acts on the resilient plate through the nozzle orifice when an ink tank is replaced, the resilient plate is prevented as much as possible from becoming deformed. Therefore, the electrodes can be prevented from breaking.

What is claimed is:

1. An ink-jet recording head comprising:

a nozzle plate having a plurality of nozzle orifices for ejecting ink droplets;

a spacer having an upper surface and a lower surface, the spacer comprising a plurality of ink cavities which are respectively connected to the nozzle orifices, the nozzle orifices being arrayed in constant pitches;

a plurality of ink supply ports connected to the respective ink cavities for supplying ink;

an ink reservoir connected to the ink supply ports for supplying ink to the plurality of ink cavities, said ink reservoir disposed substantially between a portion of the spacer and a portion of the nozzle plate, the portion of the spacer and the portion of the nozzle plate being substantially opposed to each other;

wherein the nozzle plate is disposed at the lower surface of the spacer;

a resilient plate having an upper surface and a lower surface, the lower surface of the resilient plate sealing the upper surface of the spacer, said resilient plate bringing about variations in pressure in the ink cavity;

a plurality of lower electrodes formed on the upper surface of the resilient plate;

a piezoelectric substance formed on the lower electrodes;

a plurality of upper electrodes formed on the piezoelectric substance so as to respectively correspond to the ink cavities in order to apply a signal to the piezoelectric substance; and an elastically deformable portion subjected to the ink reversely flowing from each of the plurality of ink cavities, and which is formed at least adjacent the portion of the nozzle plate and forming a wall portion of the ink reservoir, and between the portion of the spacer and the portion of the nozzle plate which are opposed to each other.

2. The ink-jet recording head as defined in claim 1, further comprising a compliance plate interposed between the spacer and the nozzle plate, and wherein a portion of the compliance plate which is disposed adjacent to the portion of the nozzle plate and opposite to the portion of the spacer opposed from the portion of the nozzle plate is the elastically deformable portion deformed by the ink reversely flowing from the ink cavity.

3. The ink-jet recording head as defined in claim 2, wherein the elastically deformable portion of the compliance plate comprises a recess in the portion of the compliance plate disposed adjacent to the ink reservoir and adjacent the portion of the nozzle plate.

4. The ink-jet recording head as defined in any one of claims 1, 2, and 3, wherein an area that is elastically deformable by the elastically deformable portion of the compliance plate, when being subjected to the ink reversely flowing from the ink cavity, is formed such that a proportional coefficient Cr satisfies, $$Cr > 8 \times n \times Cc$$

wherein Cc is a proportional coefficient between variations in a volume of one of the ink cavities and a pressure obtained when a predetermined pressure is applied to said one of the ink cavities;

n is the number of ink cavities; and

Cr is a proportional coefficient between variations in a volume of the ink reservoir and a pressure obtained when a predetermined pressure is applied to the ink reservoir.

* * * * *